US005905338A

United States Patent [19]

Verspaget et al.

[11] Patent Number: 5,905,338

[45] Date of Patent: May 18, 1999

[54] ELECTRIC LAMP

[75] Inventors: Godefridus N. M. Verspaget; Hendrikus A. M. Van Dulmen, both of Eindhoven, Netherlands

[73] Assignee: U.S. Philips Corporation, New York, N.Y.

[21] Appl. No.: 08/873,642

[22] Filed: Jun. 12, 1997

[30] Foreign Application Priority Data

Dec. 6, 1996 [EP] European Pat. Off. ..... 96201639

[51] Int. Cl.[6] ..... H01J 5/46

[52] U.S. Cl. ..... 313/623; 313/318.12; 313/624; 313/625

[58] Field of Search ..... 313/623, 318.12, 313/269, 624, 625

[56] References Cited

U.S. PATENT DOCUMENTS

| | | | |
|---|---|---|---|
| 4,015,165 | 3/1977 | Hardies . | |
| 4,139,794 | 2/1979 | Malm et al. . | |
| 4,238,705 | 12/1980 | Thomas | 313/318.12 |
| 4,823,049 | 4/1989 | Sanders et al. . | |
| 4,929,863 | 5/1990 | Verbeek et al. . | |
| 5,073,846 | 12/1991 | Lin | 362/263 |
| 5,404,077 | 4/1995 | Eichelbronner et al. | 313/623 |
| 5,412,275 | 5/1995 | Dorsemagen et al. . | |
| 5,461,554 | 10/1995 | Leonetti et al. | 362/390 |
| 5,592,049 | 1/1997 | Heider et al. | 313/623 |

FOREIGN PATENT DOCUMENTS

| | | | |
|---|---|---|---|
| 0325182A2 | 1/1989 | European Pat. Off. | H01R 33/09 |
| 0434292A2 | 12/1990 | European Pat. Off. | H01K 1/44 |
| 0643258A1 | 3/1995 | European Pat. Off. . | |
| 962016390 | 12/1996 | European Pat. Off. | H01J 61/00 |
| 7-220518 | 1/1995 | Japan | F21V 19/00 |
| 7-254393 | 10/1995 | Japan | H01K 1/46 |
| 2231717 | 11/1990 | United Kingdom | H01K 1/40 |
| WO9703319 | 1/1997 | WIPO . | |

*Primary Examiner*—Nimeshkumar D. Patel
*Attorney, Agent, or Firm*—F Brice Faller

[57] ABSTRACT

The electric lamp has a glass lamp vessel (1) having seals (3) from which an external metal wire (6) extends. A bare corrosion resistant contact wire (7), having a specific resistance of less than 0.8 $\mu\Omega$m and a hardness of 50–300 HV is welded, e.g. butt-welded to the external metal wire (6). The contact wire (7) has an axial free end portion (8). An transversally extending intermediate portion (9) may be present between the seal and the free-end portion (8). The lamp allows secure electrical connections to a luminaire easily and rapidly to be made.

8 Claims, 2 Drawing Sheets

ELECTRIC LAMP

BACKGROUND OF THE INVENTION

The invention relates to an electric lamp provided with:

A glass lamp vessel having an axis and seals in mutual opposition on said axis;

an electric element arranged in the lamp vessel;

current conductors connected to the electric element and each embedded in a respective seal and comprising an external metal wire which issues to the exterior from said seal.

Such an electric lamp and a luminaire for this lamp are known from U.S. Pat. No. 4,929,863.

The known lamp has a lamp cap at either end around the respective seal with an electrical contact which is connected to the relevant external metal wire. A conductor in a luminaire may be fixed onto the electrical contact, for example by means of a flat eye or hook cable tag present at the conductor, and clamped tightly onto the contact by means of a nut. The lamp consumes a comparatively high power of 1600 to 2000 W. This power implies that comparatively strong currents are passed through the contacts, which in their turn may assume comparatively high temperatures which involve the risk of corrosion.

The known lamp is mechanically held in the luminaire at the lamp caps by lampholders and is electrically supplied through the contacts of the lamp caps.

An alternative luminaire with lampholders for, for example, the known lamp mentioned above is known from EP-A-0,643,258.

U.S. Pat. No. EP 95 201 891.1 (U.S. Pat. No. 5,729,080) describes an electric lamp in which there are no lamp caps around the seals at the ends. A bare metal wire issues to the exterior from each seal, while a mounting member, on which a luminaire can grip the lamp mechanically, is present at a distance from each end on each seal.

U.S. Pat. No. 5,412,275 discloses a lamp whose lamp vessel is fixed at one point in a lamp cap, while a molybdenum wire issues to the exterior-from a second end of the lamp vessel, having a welded joint of good quality with a wire of nickel/manganese 98/2. The latter wire extends to inside the lamp cap, surrounded by an insulating sleeve for the major part, and is fastened to a contact member of this lamp cap.

High temperatures in a contact spot may cause corrosion of the mutually contacting conductors, which will lead to high contact resistances and thus to electrical losses, indeed to extinguishing of the lamp. Major temperature fluctuations owing to high operating temperatures may also give rise to a loosening of a clamped connection formed by a nut tightened onto a contact member. This increases the temperature as well as the risk of corrosion. It is known that, for example, molybdenum often used as a metal for the external metal wire corrodes at room temperature already.

SUMMARY OF THE INVENTION

It is an object of the invention to provide an electric lamp which is of a simple construction and in which the corrosion risk during operation is counteracted.

According to the invention, the external metal wire is made of molybdenum, and a metal, electrically non-insulated contact wire is welded thereto, has a substantially axially directed free-end portion for making contact with a contact member of an electric supply, and is made of a corrosion-resistant metal alloy with a resistivity ρ of at most 0.8μΩm and a hardness which lies in a range of 50 to 300 HV.

The electric lamp according to the invention may be mechanically retained in a luminaire by members which apply themselves at a distance from the lamp ends, for example on the seals. The connection of the lamp to the electric supply is effected at the free-end portions. The low resistivity and the comparatively low hardness value of the contact wire mentioned above jointly ensure a durable high electrical quality of the connection to a contact member of an electric supply in spite of comparatively high operating temperatures of, for example, approximately 250° C. The surface quality of the contact wire, and thus its contact resistance, does not substantially change at this operating temperature as time progresses.

The hardness of the alloy is important here because this hardness renders it possible for the end portion to be both elastically and plastically deformed during contacting at a comparatively small exerted force, for example of approximately 8 to approximately 12N. The end portion then adjusts itself to the shape of a comparatively hard contact member by which it is held and thus increases the surface area of the contact surface, which would be a straight line in the case of a hard straight wire on a flat surface, thus decreasing the electrical contact resistance. As a result of this, the contact member maintains its surface quality owing to a comparatively high hardness value, for example chosen to lie in the range of 200 to 600 HV (Vickers hardness), so as to be able to contact a new lamp in the same manner at the end of life of the present lamp. The comparatively low resistivity keeps the heat generation in the contact wire itself low. Since the contact wire adapts itself to the surface of a comparatively hard contact member owing to the comparatively low hardness of the former, an interface between contact wire and contact member is obtained which is hardly or not accessible to polluting agents from the air such as moisture, oxygen, sulphur compounds, nitrogen oxides, etc.

Various metals may be chosen for the contact wire, such as nickel and alloys thereof. Copper alloys are also possible. Examples of materials are listed in Table 1 below, trace elements in the compositions not being mentioned therein.

TABLE 1

| material | Ni | NiCu30Al | NiCuFe | CuCrZr | NiMn2 |
|---|---|---|---|---|---|
| composition (% by weight) | | Cu 29<br>Al 2.5<br>Ni rest | Cu 31<br>Fe < 1<br>Ni rest | Cr 1<br>Zr 0.2<br>Cu rest | Mn 2<br>Ni rest |
| ρ (μΩm) | 0.069 | 0.61 | 0.55 | 0.021 | 0.12 |
| hardness | ca 100 | 250–300 | ca 220 | 150–200 | 100–120 |

It is favorable when an intermediate portion extending transversely to the axis and passing a current during operation is present between the seal and the free-end portion of the contact wire in view of differences in linear coefficients of expansion between the lamp and its metal parts on the one hand and a luminaire in which the lamp is to be used on the other hand. This intermediate portion may have the shape, for example, of an open hairpin or of a curl situated in an axial plane. It is convenient, however, when the intermediate portion is substantially coiled into a helical shape. The free-end portion can then easily adjust itself in all directions to the contact member in which it is to be accommodated in a luminaire.

In a favorable embodiment, the intermediate portion is integral with the contact wire.

It is favorable when the contact wire has a butt weld with the external metal wire. It is easy then to position the free-end portion of the contact wire substantially on the axis of the lamp vessel.

The electric element of the lamp may be a pair of electrodes in an ionizable medium or an incandescent body, for example in an inert gas to which a halogen or a halogen compound may have been added. The electric element may be accommodated in an inner envelope, if so desired. The lamp vessel may be made of hard glass or of a glass having an $SiO_2$ content of at least 95% by weight such as, for example, quartz glass. The current conductors may comprise metal foils, for example molybdenum foils, in the seals and conductors of, for example, molybdenum or tungsten inside the lamp vessel. Alternatively, a wire, for example made of molybdenum, may traverse each seal.

DESCRIPTION OF THE PREFERRED EMBODIMENTS

Figure 1:
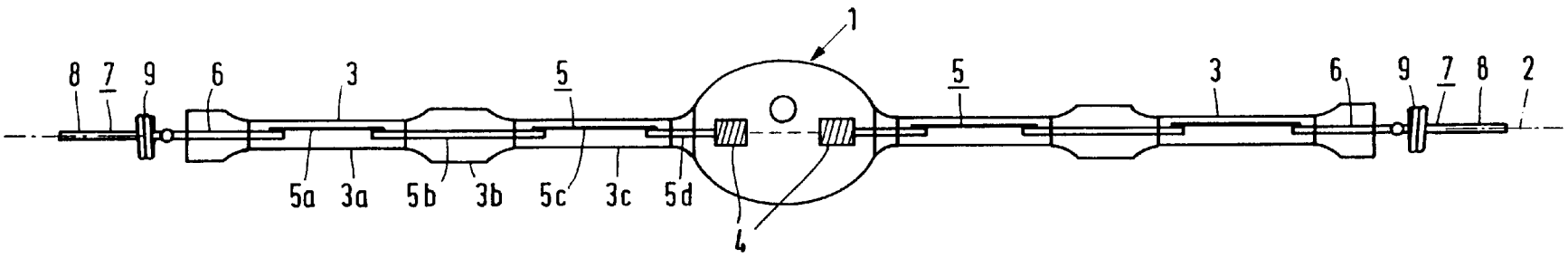
FIG. 1 shows the lamp in side elevation.

In FIG. 1, the electric lamp is provided with a glass lamp vessel 1 with an axis 2 and mutually opposed seals 3 which lie on the axis. An electric element 4 is arranged in the lamp vessel. Current conductors 5 are connected to the electric element 4 and embedded each in a respective seal 3. They each comprise an external metal wire 6 which issues to the exterior from the seal 3.

In the Figure, each seal 3 has a first 3*a* and a second gastight portion 3*c* between which there is a cavity 3*b* filled with an inert gas, for example nitrogen. The current conductors 5 comprise metal foils 5*a* and 5*c* embedded in respective gastight portions 3*a* and 3*c*, and a wire 5*b* in the cavity 3*b* as well as a wire 5*d* which supports the electric element 4. The straight wire 5*b*, for example made of molybdenum, transports heat to the surroundings of the lamp via the inert gas, so that the wire 6 is exposed to the ambient air in a cooler state than would otherwise be the case. The electric element 4 is a pair of electrodes in an ionizable medium, for example comprising a rare gas, mercury, and metal halides. The lamp consumes a power of approximately 1800 W during nominal operation.

Figure 2:
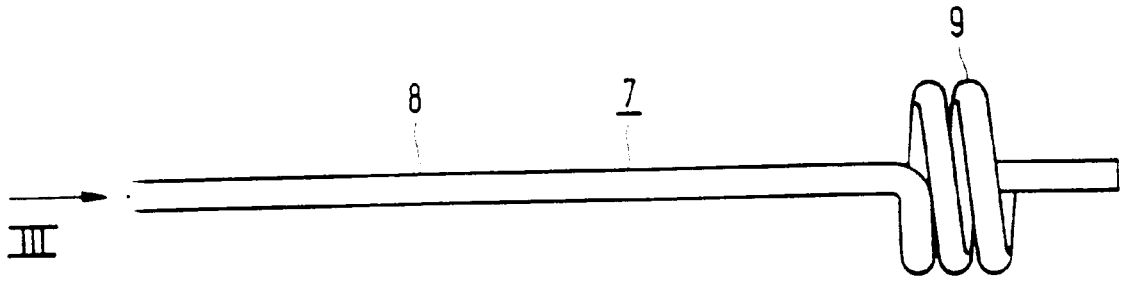
FIG. 2 shows the contact wire of FIG. 1 on an enlarged scale.
Figure 3:
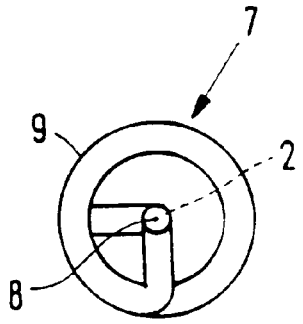
FIG. 3 shows the contact wire taken on the line III in FIG. 2.

The external metal wire 6 is made of molybdenum, and a metal, electrically non-insulated contact wire 7 is welded thereto and has a substantially axially directed free-end portion 8, see also FIGS. 2 and 3, for making contact with a contact member of an electric supply. The contact wire is of a corrosion-resistant metal alloy with a resistivity ρ of at most 0.8 $\mu\Omega$m and a hardness which lies in the range of 50 to 300 HV.

An intermediate portion 9, which extends transversely to the axis 2, which passes a current during operation, which is integral with the contact wire 7, and which is substantially helically coiled, is present between the seal 3 and the free-end portion 8.

The contact wire 7 has a butt weld joint with the external metal wire 6. The free-end portion 8 is positioned substantially on the axis 2 of the lamp vessel 1.

In the FIGS, the contact wire is made of NiMn2with a hardness of 100–120 VH. Before being butt-welded to the external metal wire 6, the contact wire was annealed for 15 minutes at 950° C. in nitrogen with 5% hydrogen by volume, and subsequently cooled down in a flow of 10 l/min of the same gas so as to give the wire its low hardness value of approximately 100–120 HV.

We claim:

1. An electric lamp comprising:

a glass lamp vessel (1) having an axis (2) and seals (3) in mutual opposition on said axis;

an electric element (4) arranged in the lamp vessel;

current conductors (5) connected to the electric element (4) and each embedded in a respective seal (3) and comprising an external metal wire (6) made of molybdenum which issues to exterior ambient air from said seal (3), and a metal, electrically non-insulated contact wire (7) which is welded to said external metal wire at a joint in said ambient air, has a substantially axially directed free-end portion (8) for making contact with a contact member of an electric supply, and is made of a corrosion-resistant metal alloy with a resistivity ρ of at most 0.8 $\mu\Omega$m and a hardness which lies in a range of 50 to 300 HV.

2. An electric lamp as claimed in claim 1, characterized in that said contact wire (7) comprises an intermediate portion (9), which extends transversely to the axis (2) and which passes a current during operation, between the seal (3) and the free-end portion (8) of the contact wire (7).

3. An electric lamp as claimed in claim 2, characterized in that the intermediate portion (9) is substantially helically coiled.

4. An electric lamp as claimed in claim 1, characterized in that the joint is a butt-welded joint.

5. An electric lamp as in claim 1 wherein said corrosion resistant metal alloy has a hardness of which lies in a range of 50 to 120 HV.

6. An electric lamp as in claim 5 wherein said corrosion resistant metal alloy consists essentially of nickel.

7. An electric lamp as in claim 6 wherein said corrosion resistant metal alloy is NiMn2with a hardness of 100–120 HV.

8. An electric lamp as in claim 6 wherein said corrosion resistant metal alloy which has a resistivity of at most 0.12 $\mu\Omega$m.

* * * * *